US007182133B2

(12) United States Patent
Webre et al.

(10) Patent No.: US 7,182,133 B2
(45) Date of Patent: Feb. 27, 2007

(54) ELEVATOR SENSOR

(75) Inventors: Charles Michael Webre, Lafayette, LA (US); Michael Wayne Olivier, Broussard, LA (US); Jeremy Richard Angelle, Lafayette, LA (US); Vernon Joseph Bouligny, Jr., New Iberia, LA (US); Mark Stephen Sibille, Lafayette, LA (US); Richard J. Wiggins, Lafayette, LA (US); Brian D. Begnaud, Youngsville, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 33 days.

(21) Appl. No.: 10/728,443

(22) Filed: Dec. 5, 2003

(65) Prior Publication Data

US 2004/0159425 A1 Aug. 19, 2004

Related U.S. Application Data

(63) Continuation-in-part of application No. 10/067,470, filed on Feb. 4, 2002, now abandoned.

(51) Int. Cl.
*E21B 19/06* (2006.01)
*E21B 19/00* (2006.01)
*E21B 47/00* (2006.01)

(52) U.S. Cl. ..... 166/250.01; 166/77.52; 166/66; 175/40; 700/303

(58) Field of Classification Search ..... 166/77.52, 166/250.01, 66; 700/303; 175/40
See application file for complete search history.

(56) References Cited

U.S. PATENT DOCUMENTS 3,191,683 A * 6/1965 Alexander ..... 166/53
3,374,341 A 3/1968 Klotz
3,540,266 A * 11/1970 Lofgren ..... 73/637
3,881,375 A 5/1975 Kelly
3,904,234 A 9/1975 Hill et al.
4,020,688 A * 5/1977 Hauldren ..... 73/152.43
4,110,688 A 8/1978 Bailey
4,139,891 A 2/1979 Sheldon et al.
4,202,225 A 5/1980 Sheldon et al.
4,269,554 A 5/1981 Jackson
4,531,875 A 7/1985 Krueger
4,577,700 A 3/1986 Dellinger et al.
4,616,321 A 10/1986 Chan
4,621,974 A 11/1986 Krueger
4,747,451 A 5/1988 Adams, Jr. et al.
4,748,563 A 5/1988 Anthoine
4,752,682 A 6/1988 Beck et al.
4,829,489 A * 5/1989 Rector ..... 367/82
4,852,665 A 8/1989 Peltier et al.
5,014,781 A 5/1991 Smith
5,220,536 A 6/1993 Stringer et al.
5,826,654 A * 10/1998 Adnan et al. ..... 166/250.01

(Continued)

*Primary Examiner*—David Bagnell
*Assistant Examiner*—Shane Bomar
(74) *Attorney, Agent, or Firm*—The Matthews Firm

(57) ABSTRACT

At least one sensor is mounted for monitoring the vertical position of an elevator relative to selected features on a tubular string. A variety of sensor types is provided. Optional mounting arrangement permits the sensors to be situated close to a tubular and free to move laterally. Excess lateral movement of the tubular moves the mounting; thus, reducing the shock to the sensors. In an additional embodiment, a sensor can provide position indication for tools or other equipment being lowered into the wellbore or into a tubular. In yet another embodiment, sensors are mounted to both indicate selected features on a tubular string and the position of tools being lowered into the tubular string.

19 Claims, 9 Drawing Sheets

U.S. PATENT DOCUMENTS 5,923,428 A 7/1999 Woodworth
6,017,198 A 1/2000 Traylor et al.
6,073,699 A * 6/2000 Hollingsworth, Jr. ..... 166/379
6,179,065 B1 1/2001 Payne et al.
6,478,087 B2 * 11/2002 Allen ..... 166/255.1
6,497,159 B1 * 12/2002 Lavoie ..... 73/866.5
6,558,241 B2 * 5/2003 Hergott et al. ..... 452/31
6,626,238 B2 9/2003 Hooper
2005/0120812 A1 * 6/2005 Edwin et al. ..... 73/865.8
2005/0123356 A1 * 6/2005 Wilkinson ..... 405/184.5

* cited by examiner

ELEVATOR SENSOR

RELATED APPLICATION

This application is a continuation in part of U.S. patent application Ser. No. 10/067,470 having a filing date of Feb. 4, 2002 now abandoned.

FIELD OF THE INVENTION

The present invention relates generally to a sensing apparatus for locating tubular characteristics or the location of a tubular. More specifically, the present invention relates to detecting position or characteristics of tubulars or other equipment relative to the horizontal displacement of equipment such as elevators on drilling and servicing rigs.

While the present invention will be described in connection with presently contemplated embodiments, it will be understood that it is not intended to limit the invention to those embodiments. Further it should be understood that the drawings used to illustrate these embodiments are also not intended to limit the present invention but are intended to disclose the presently contemplated embodiments. These descriptions and drawings are intended to cover all alternatives, modifications, and equivalents included within the spirit of the invention.

DETAILED DESCRIPTION OF EMBODIMENTS

Figure 1:
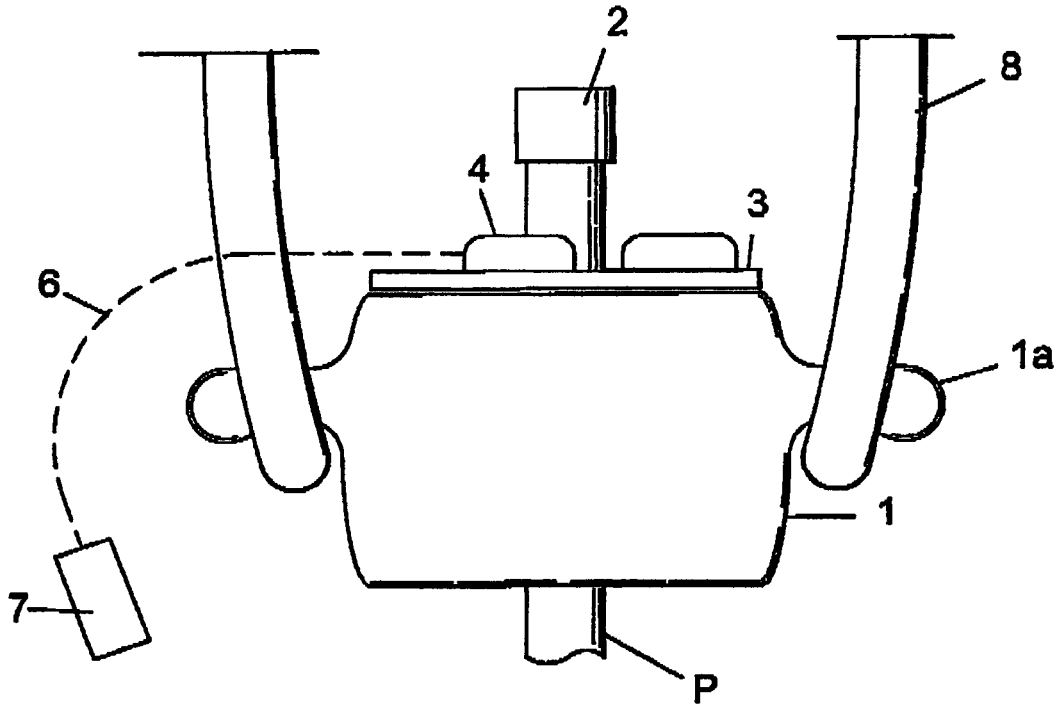
FIG. 1 illustrates a side elevation of a typical elevator suspended by bails from the traveling block.
Figure 2:
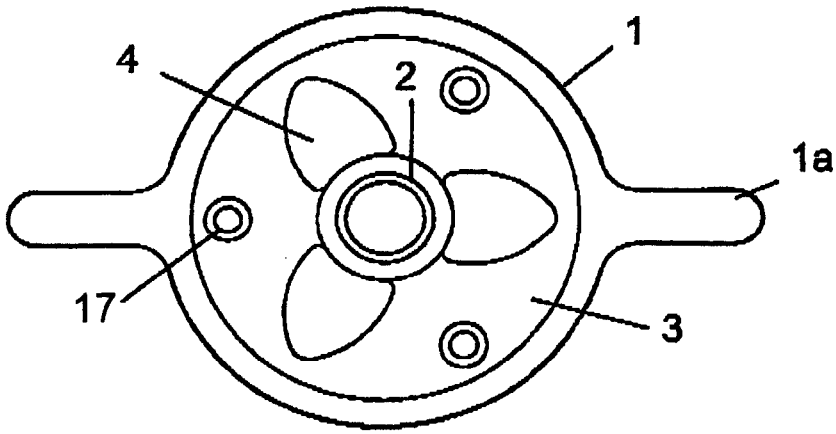
FIG. 2 illustrates a top view of the elevator of FIG. 1, without bails.

FIGS. 1 and 2 show a conventional drilling rig slip-type elevator 1 with a tubular P extending through the central opening and terminating with a collar 2. Elevator 1 is typically suspended via bails 8 connected to the elevator, in a conventional manner at l*a*. Sensors 4 respond to changes in detectable characteristics of tubular P. The sensors 4 are illustrated, in FIGS. 1 and 2, to provide a general notion of location. It should be noted that the sensors 4 can be a variety of types and shapes and thus present a variety of different mounting requirements. Further detail of the sensors 4 and their preferable ways of mounting will be described in more detail herein below. Because the elevator 1 and slips 9 (see FIG. 5) are sized as to be raised or lowered over a tubular P, there is at least some clearance between the outer diameter of tubular P and the inner diameter of the elevator 1 and slips 9. This clearance typically varies depending on the size of the tubular P and the elevator 1. Thus, the tubular may move in a lateral direction before the slips are set. It should be appreciated that the described lateral tubular movement would include any lateral movement of the elevator. Many types of sensors 4, can properly function even when the sensor target, such as tubular P, is some certain distance away from the sensor. However, when the distance limitation is exceeded, possibly such as when the lateral movement of tubular P is at some maximum distance, the sensors 4 may not be able to properly function. It should be appreciated that the sensors' 4 proximity to the target, within the sensors' distance limitations, may be aided through the use of a transition plate 3.

Figure 5:
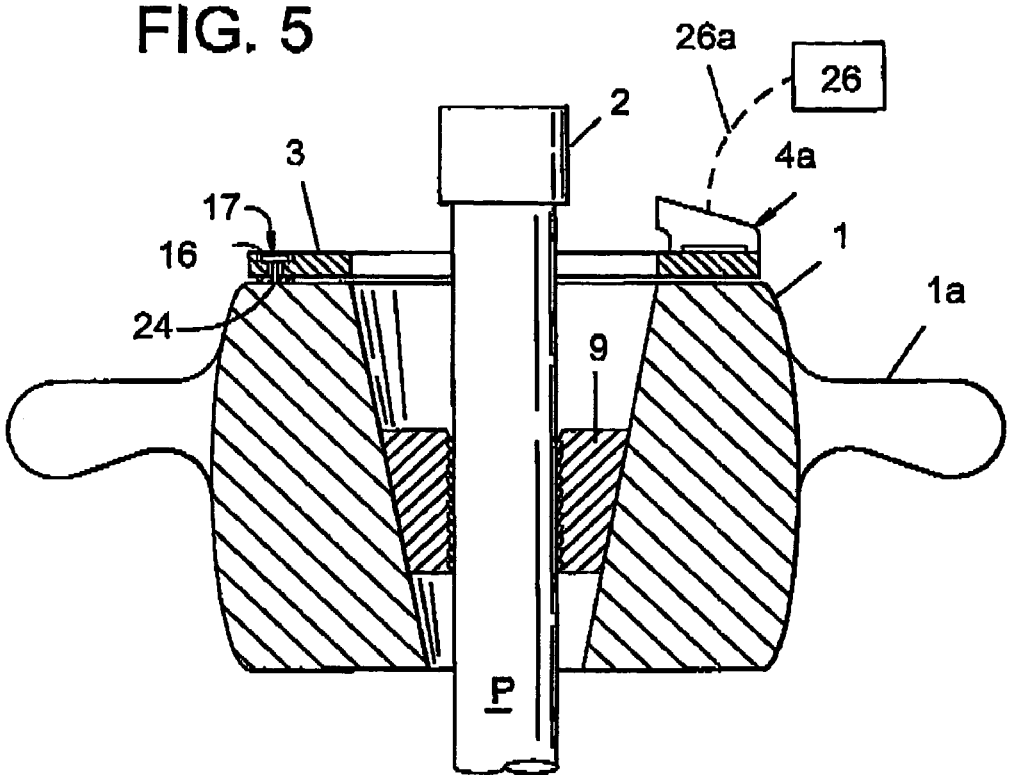
FIG. 5 illustrates a side view of the elevator of FIG. 1 with no bails but having a transition plate to carry the sensors.

Such a transition plate 3 can be used to carry the sensors 4 and move in a lateral direction. The lateral movement, of transition plate 3 is likely to be caused by contact between the tubular P and the transition plate 3 as the elevator 1 is being raised or lowered over the tubular P. The transition plate 3, best seen in FIG. 5, is preferably mounted to the elevator 1 using vertically confining shoulder screws 17 in laterally loose holes 24. This assembly is generally designated with the number 16. It should be appreciated that the transition plate 3 can be mounted in a variety of ways which can include, but is not limited to, screws, bolts, rivets, and the like in combination with lateral slots 24. It is also envisioned that the transition plate 3 can be a combination of more than one plate wherein such additional plates would secure against vertical movement while at the same time allowing lateral movement. The sensors 4 can thus be mounted closer to the tubular P yet allow the tubular P to move a greater lateral distance without damaging the sensors 4.

Figure 3:
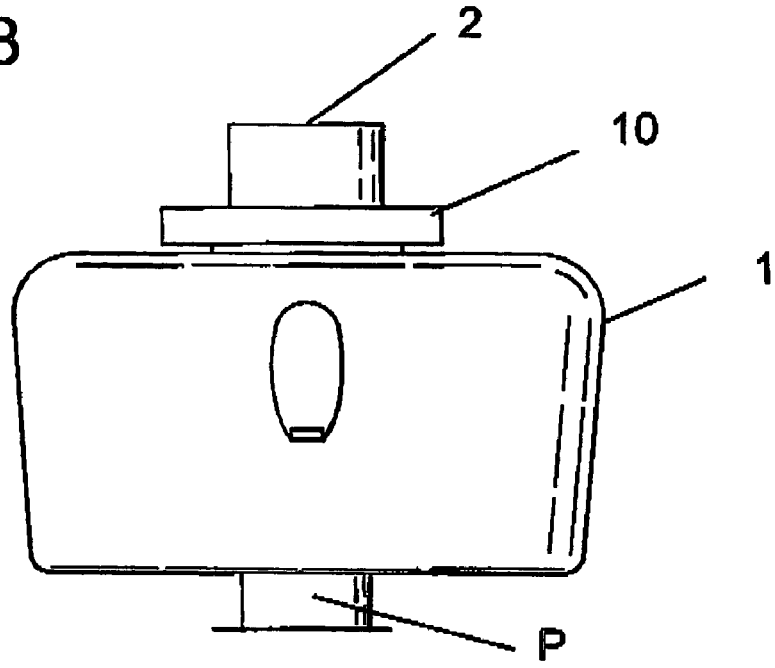
FIG. 3 illustrates a side view of a light curtain sensor mounted on an elevator.
Figure 4:
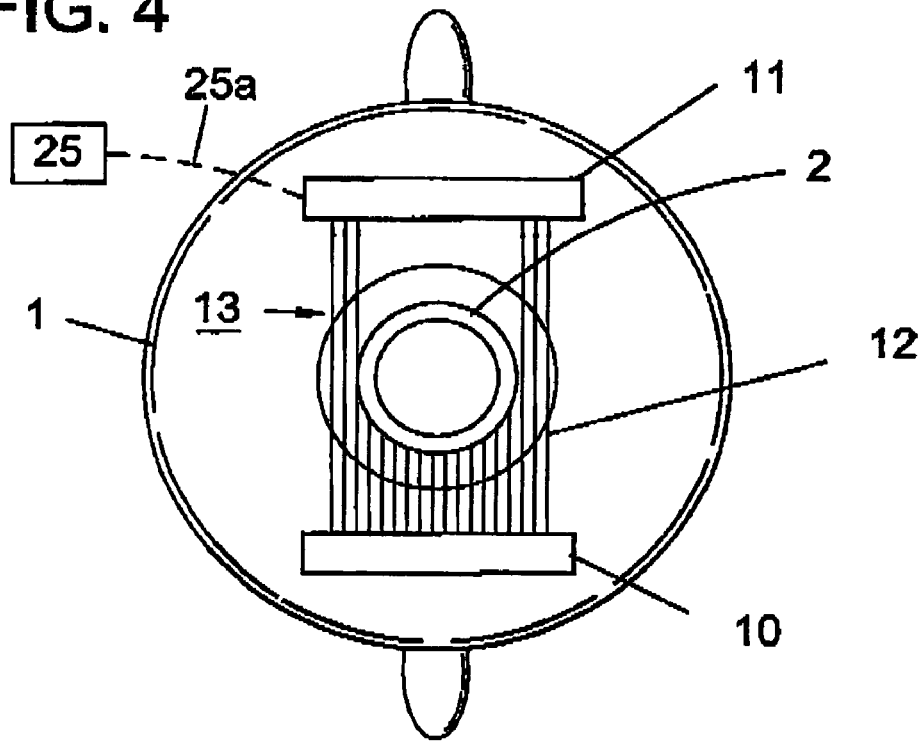
FIG. 4 illustrates a top view of the assembly of FIG. 3.

FIGS. 3 and 4 illustrate a type of sensor 4 which comprises a multiple beam light projector 10 and receiver 11 arrangement conventionally known as a light curtain, designated generally as 13. It should be appreciated that such a light curtain 13 arrangement is commercially available. It should further be appreciated that the light curtain 13 can be mounted directly to the elevator 1 or can be mounted to a transition plate 3. A conventional means of mounting is preferred wherein the light curtain 13 can be removed, adjusted, repaired, or the like without an inordinate effort and preferably without substantial interruption of rig activities.

The light curtain 13 is usable as a remote sensor to preferably measure features by the number of light beams occluded. Projector housing 10 preferably projects the plural beams of light 12 across the area to be partly occluded by tubular P as the tubular P passes through the elevator 1. As tubular P passes through and occludes some of the plural beams of light 12, receiver housing 11 preferably receives the surviving light beams, i.e. those beams of light that are not occluded by the tubular P, and may produce a consequent signal output usable by the operating personnel or any ancillary apparatus used to convert the information sent from the light curtain 13. Preferably, the projector housing 10 is of a size suitable to project the plural beams of light 12 to cover an area equal to or greater than the diameter of the elevator 1 throughbore. Preferably, the light beams 12 are equally spaced some pre-determined distance apart and form a substantially horizontal plane which is substantially perpendicular to the elevator through bore and the length of such plane is greater than or equal to the through bore diameter. Preferably, receiver housing 11 is of a suitable size such that it can receive all of the plural light beams 12 projected by projector housing 10. Preferably, as the tubular P enters the projected light beams 12, it will begin to occlude light beams 12 in a manner such that only the light beams on each distal end of the horizontal plane will pass un-occluded to the receiver in receiver housing 11. The length of the occluded horizontal plane will preferably indicate the outside diameter of the tubular P. As illustrated in FIG. 1, the tubular P preferably has a collar 2 which passes through the light beams 12. It should be appreciated, by those in the art, that the collar 2 can be a coupling, a connector, an upset end, or the like. Thus, as the coupling, upset end, or collar 2 portion passes through the light beams 12, fewer beams 12 will be occluded indicating that the tubular P, which preferably has a smaller diameter that the collar 2, is positioned at the level of the light beam 12 horizontal plane. The signal processing 25 is preferably situated in one of the housings or can be remotely attached as illustrated in FIG. 4. Also as illustrated in FIG. 4, the signal from the receiver 11 will preferably cause a signal to be sent along communication link 25A to the processor 25 which will preferably translate the signal to some readable output to read out near the operating personnel, to connect to automated controls, computers, or any other desired apparatus which can receive the signal or further process the signal if necessary. It should be appreciated that the light curtain 13, as a conventional and commercially available apparatus, needs not be functionally described in detail herein. It should further be appreciated that the processing 25 is also commercially available and can include, but not be limited to, conventional filters, signal conditioners, computer processors, computer cells, and the like. The choice of selecting the use of the light curtain sensor 13 is primarily a function of the rig environment such that the plural light beams 12 are not occluded other than by the tubular P or any equipment intentionally being passed through the light beams 12. It should be noted that the use of secondary sensors as a form of a redundant signal can be utilized to confirm the proper function and operation of the light curtain 13.

Referring again to FIG. 5, which illustrates a general purpose sensor mounting arrangement which can be utilized in the embodiment illustrated in FIG. 1. Sensor 4*a* preferably comprises more than one sensor and such sensors 4*a* are mounted on top of the elevator 1 or transition plate 3 and arranged circumferentially about the through bore of the elevator 1 or transition plate 3. It should be appreciated that the sensors 4*a* are removably attached preferably as suggested by the sensor manufacturer. These sensors 4*a* can be magnetic, capacitive, sound, light, contact sensor, or other sensing apparatus, or a combination of more than one type of sensor. It should be appreciated that sensors 4*a* are commercially available sensors and therefore the specific operational functionality, of the various types of sensors, will not be described herein as such information is readily available from the sensor manufacturer. The specific selection as to the type of sensor, i.e. magnetic, capacitive, sound, light, contact sensor, or other sensing apparatus, or a combination of more than one type of sensor, can be a function of the rig environment, operator preferences, required sensing parameters, durability requirements, maintenance feasibility, and the like. It should further be appreciated that specific sensor types can include specific signal processing equipment 26 which is also commercially available. The specific processing equipment 26 will preferably receive a signal, from the sensor 4*a*, along the communication link 26A and may convert the signal, generated by the sensors 4*a*, to an indicator, such as an audible alarm, light, controller interlock, or similar indicator, which is then used by the operations personnel or an operations control system, to assess the position of the elevator 1 and thus slips 9 in relationship to the tubular P.

The sensor 4*a* preferably detects the change in diameter or other pre-determined detectable characteristic of the tubular P when the elevator 1 is moving over the tubular P. The change, in diameter or the sensing of the pre-determined characteristic, will preferably cause the sensor to send a signal along communication link 6 (FIG. 1) to read out near the operating personnel, to connect to automated controls, computers, or any other desired apparatus which can receive and process the signal. If an automatic driller is in charge, unit 7 (FIG. 1) can be the input receiver for the device involved. Link 6 may include any form of communication and may extend to a number of end user entities such as control panels, signal lights, alarms, computer systems and the like.

The operation of the assembly, illustrated in FIG. 5, can best be understood by considering the mode when the elevator 1 is lowered over the collar 2 illustrated in FIG. 5. Preferably, the elevator slips could be closed as soon as the collar 2 is sensed if the sensors, such as, but not limited to the sensors 4*a* illustrated in FIG. 5, are positioned such as to detect the collar 2 after it has cleared the slips 9 by some pre-determined distance. It should be appreciated that if desired, the sensors 4*a* may stop the decent or assent of the elevator 1 or provide a signal for the operator to stop the assent or decent to allow the slips 9 to be closed.

Figure 6:
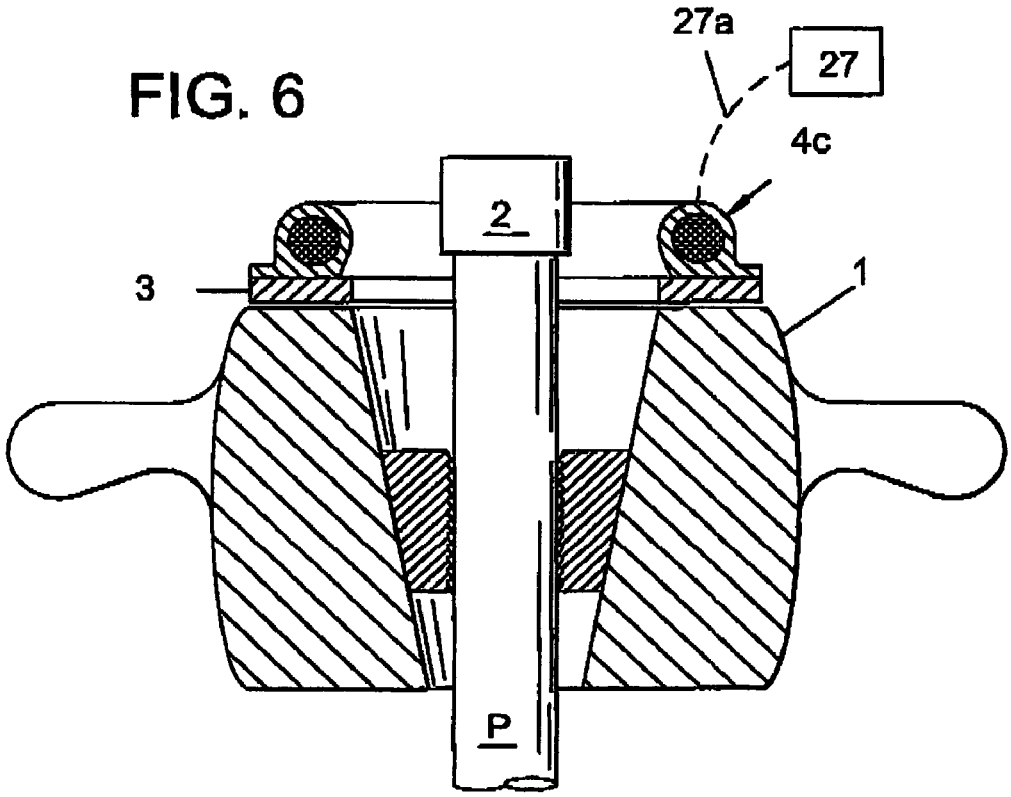
FIG. 6 is similar to FIG. 5 but illustrates a single peripheral sensor.

FIG. 6 illustrates a sensor 4*c* distributed peripherally around the tubular P. The transition plate 3 is shown but may not be needed in all cases. The sensor 4*c* can be fixedly or removably mounted directly to the elevator 1 or to the transition plate 3. The specific attachment of the sensor 4*c* should preferably be as per recommended sensor's 4*c* manufacturer. Preferably, the sensor 4*c* will include mounting plates, holes, ears, or the like which will enable securing the sensor 4*c* to the elevator 1 or transition plate 3 in a manner such as not to interfere with the sensing function. It should be appreciated, that as with some other commercially produced apparatuses slight mounting modification may be required to ensure the proper placement of the sensor 4*c*. This proper placement is usually pre-determined by the operating personnel in conjunction with the sensor manufacturer and field testing and will not require undue experimentation in actual operation. The sensor 4*c* can be, but is not limited to, a magnetic coil, capacitive plate, or air flow interference. Preferably, sensors 4*c* are commercially available sensors and the exact operational functionality of such sensors needs not be described herein. It should be understood that the function of the sensor 4*c* is to determine when the tubular P passes through the elevator 1 through bore and more specifically when the collar or coupler 2 has extended past the sensor 4*c*. The selection of the specific type of sensor 4*c* is again a function of the rig environment. It should be appreciated that the use of a magnetic coil or capacitive plate may be limited by rig safety concerns regarding electric sparks or even the availability of electricity. Still further, air flow interference sensors rely on the availability of sufficient air pressure. Conventional controlling processors 27, which operate the sensors 4*c* and convert the sensor 4*c* output to operator personnel usable information may be mounted on the elevator or remotely as illustrated. Preferably, the signal will be transmitted to the processor 27 along the communication link 27A. It should be understood that the some sensors 4*c* may have the controlling processors 27 integral to the sensor while others may require the direct mounting of the processors 27 in conjunction with the mounting of the sensors 4*c* and while still other sensors 4*c* may have processors 27 remotely mounted.

Figure 7:
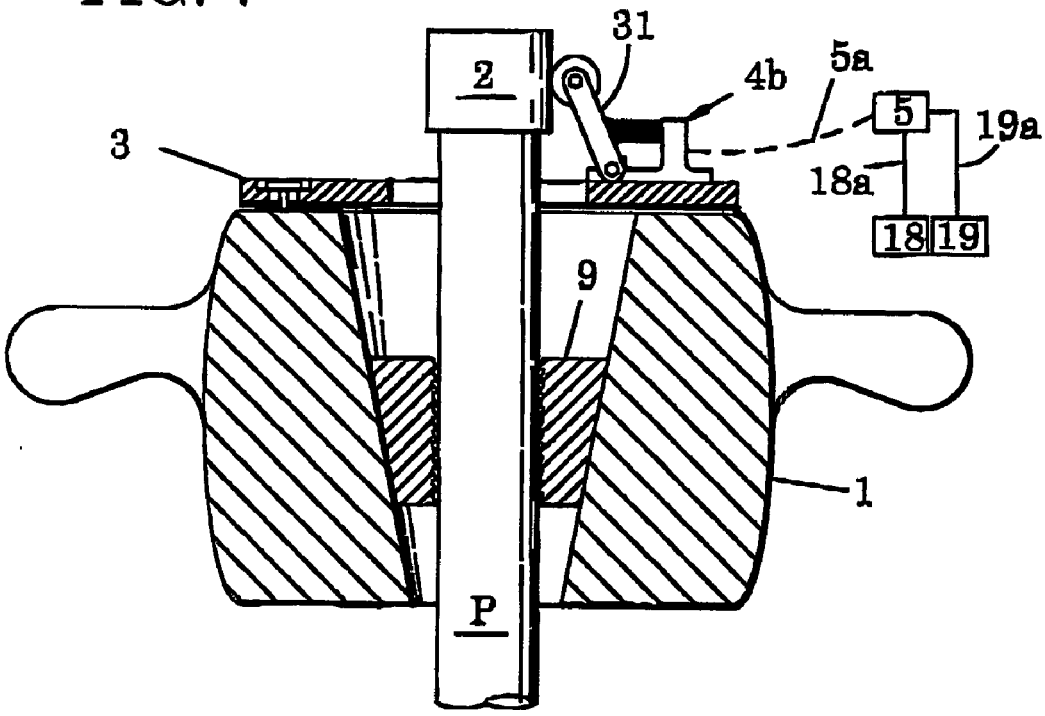
FIG. 7 is similar to FIG. 5 but illustrates an alternate sensor arrangement.

FIG. 7 is similar to FIG. 5 but illustrates mechanical contact feeler sensors 4*b* that includes a spring 15 which preferably biases the sensor 4*b* toward the tubular P. Position sensors, such as or similar to sensor 21 (FIG. 9), preferably detect the position of all feelers and preferably convey the information, along communication link 5A to a conventional computer cell 5. The computer cell 5 may be integral to the sensors 4*b*, may 15 be mounted on the transition plate 3, or located elsewhere as desired. It should be understood that the computer cell 5 is a conventional and commercially available apparatus that converts the input signal, from the sensors 4*b*, to an output signal. It should further be understood that the input from the mechanical contact feeler sensor 4*b* would preferably be the movement of the sensor arm 31 as it is moved forward or rearward in response to the tubular P, collar 2, or other rig equipment passing by the sensor 4*b*. It should still further be appreciated that the output signal, from the computer cell 5, may be transmitted directly, along the communication link 18A, to some indicator 18 comprising, but not limited to, an audible alarm or visual signal, or the output signal could be transmitted, along the communication link 19A, to another processor 19. Such processor 19 could then convert the output signal to directly operate some rig apparatus to stop the movement of the elevator , to reverse the movement of the elevator, to engage or disengage the slips, or even transmit the signal to some rig interlock system or computer operating system. Preferably the computer cell 5 will translate the sensor 4*b* input signal to indicate the diameter of the tubular P or indicate a change in diameter, which preferably indicates that a collar 2 is sensed.

Figure 8:
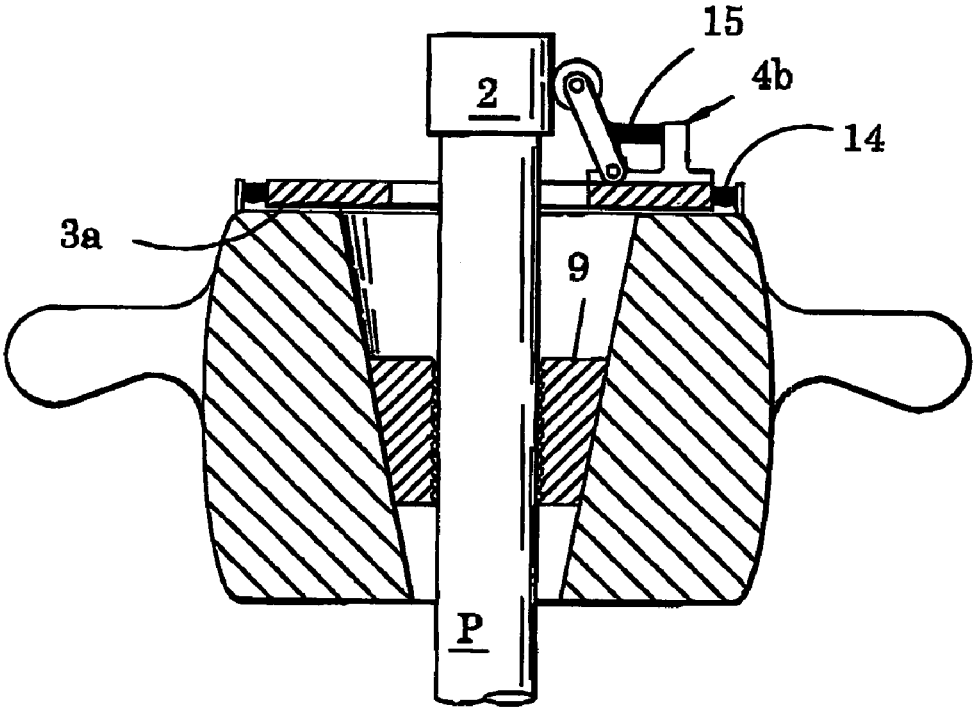
FIG. 8 is similar to FIG. 7 but illustrates a mechanical feeler sensor mounted on a transition plate that is spring centered.

FIG. 8 illustrates another embodiment of the transition plate 3. In this embodiment, the translation plate 3*a* comprises a spring bias arrangement. The bias is preferably provided by springs 14 that tend to center the transition plate 3*a* in relation to the elevator 1 through bore. The translation plate 3*a* would be mounted to the elevator 1 in a similar fashion to translation plate 3 (FIG. 5). However, whenever the translation plate 3*a* is moved laterally, such as when the plate is contacted by the tubular P or the collar 2, the springs 14 would preferably return the transition plate 3*a* to a centered position when the tubular P or collar 2 no longer contacts the transition plate 3*a*. Preferably this will still allow the springs 15 on the sensor feelers 4*b* to collectively influence the position of the transition plate 3*a* and therefore reduce any shock imposed by transition plate's 3*a* travel limits.

Figure 9:
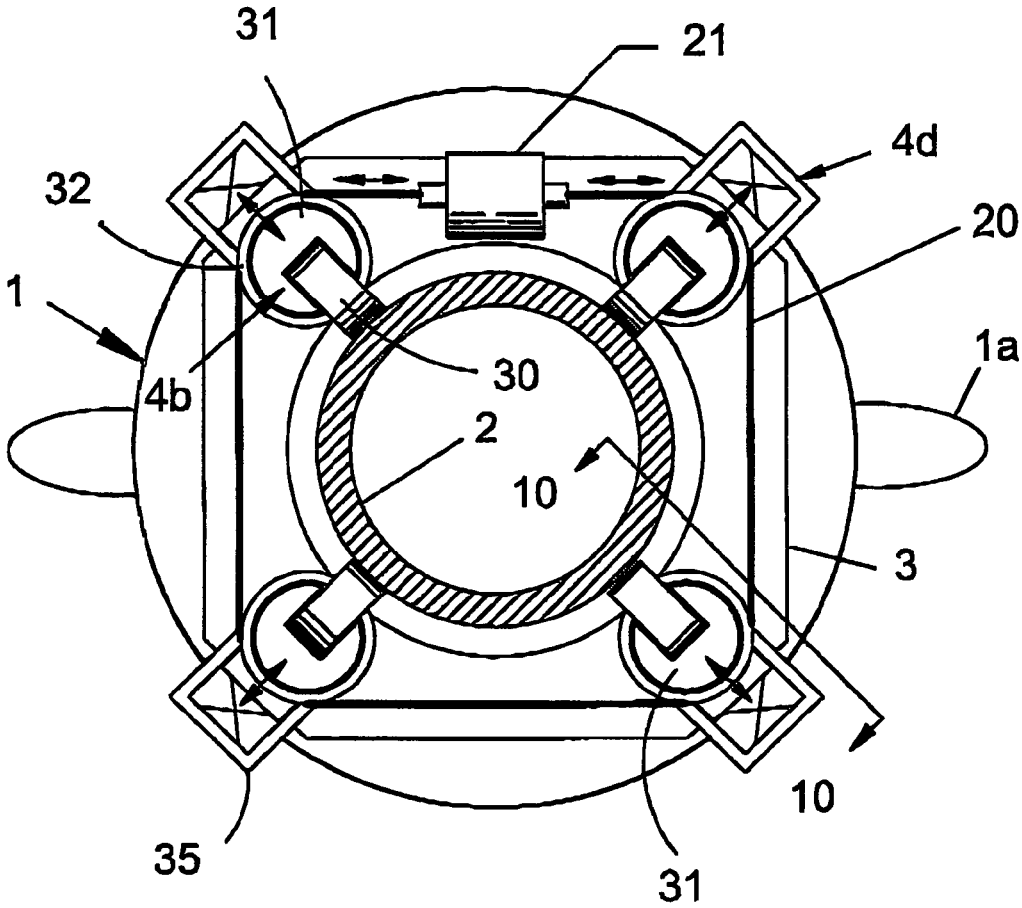
FIG. 9 is similar to FIG. 8 but in a top view illustrates a plurality of mechanical feeler sensors and an apparatus to amplify the signal from each transducer to increase the magnitude of the mechanical output signal.
Figure 10:
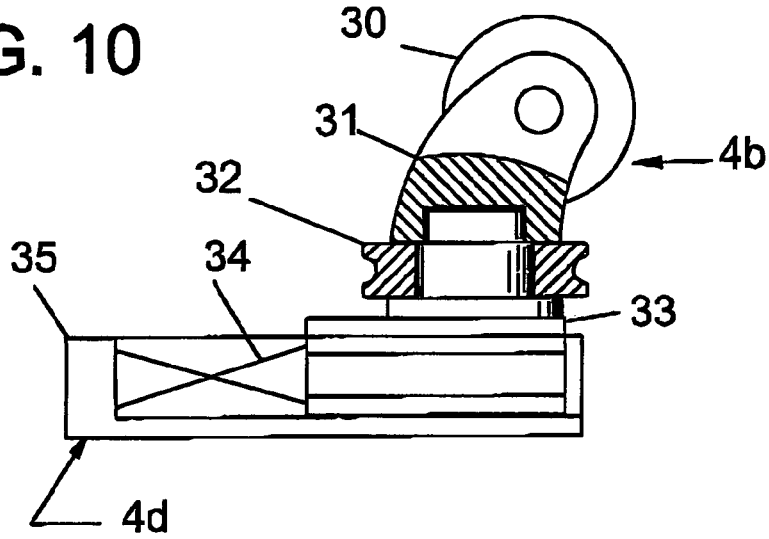
FIG. 10 illustrates a side view of one sensor mounted as illustrated in FIG. 9.

FIGS. 9 and 10 illustrate a more detailed description of the mechanical sensors illustrated in FIGS. 7 and 8. Elevator 1 may be fitted with a transition plate 3 which preferably carries the sensor assemblies 4*d*. It should be appreciated that sensors assemblies 4*d* preferably carry the sensors 4*b* illustrated in FIGS. 7 and 8. The mechanical contact sensors preferably move radially from the tubular P or collar 2 centerline. A wire line, or filament 20 circumnavigates the pulleys 32 which are preferably carried by the sensor slides 33. The spring 34 urges the sensor slides 33 toward the tubular P and preferably urges slideway 35 away from the tubular P (below the collar 2). The collective bias applied to the slideways 35 may centralize the transition plate 3 relative to the tubular P being sensed. It should be appreciated that the system may operate without the transition plate 3 but, in such a case, the slideways 35 may need to be longer to extend the travel of the slides 33. A conventional stanchion or arm 31 may connect the sensor 4*b* wheel 30 and the slide 33.

The filament 20 preferably responds to the radial movement of the sensors 4*b* collectively and may move the input to sensor 21 a pre-determined amount relative to the sensed change in diameter of the related tubular component. The filament 20 preferably processes the input signals from the sensors 4*b* collectively. It should be appreciated, by those in the art that any desired equivalent system may be used. Sensor 21 is preferably a pneumatic valve which controls air flow related to slip closure in the elevator. In converting movement of said filament 20 to changes in fluid flow resistance, the valve (or the sensor 21) preferably serves as a form of signal conditioner which translates the radial movement of the sensors 4*b* into an output signal which can further be processed into an indication of some predetermined tubular P or collar 2 characteristic.

Figure 11:
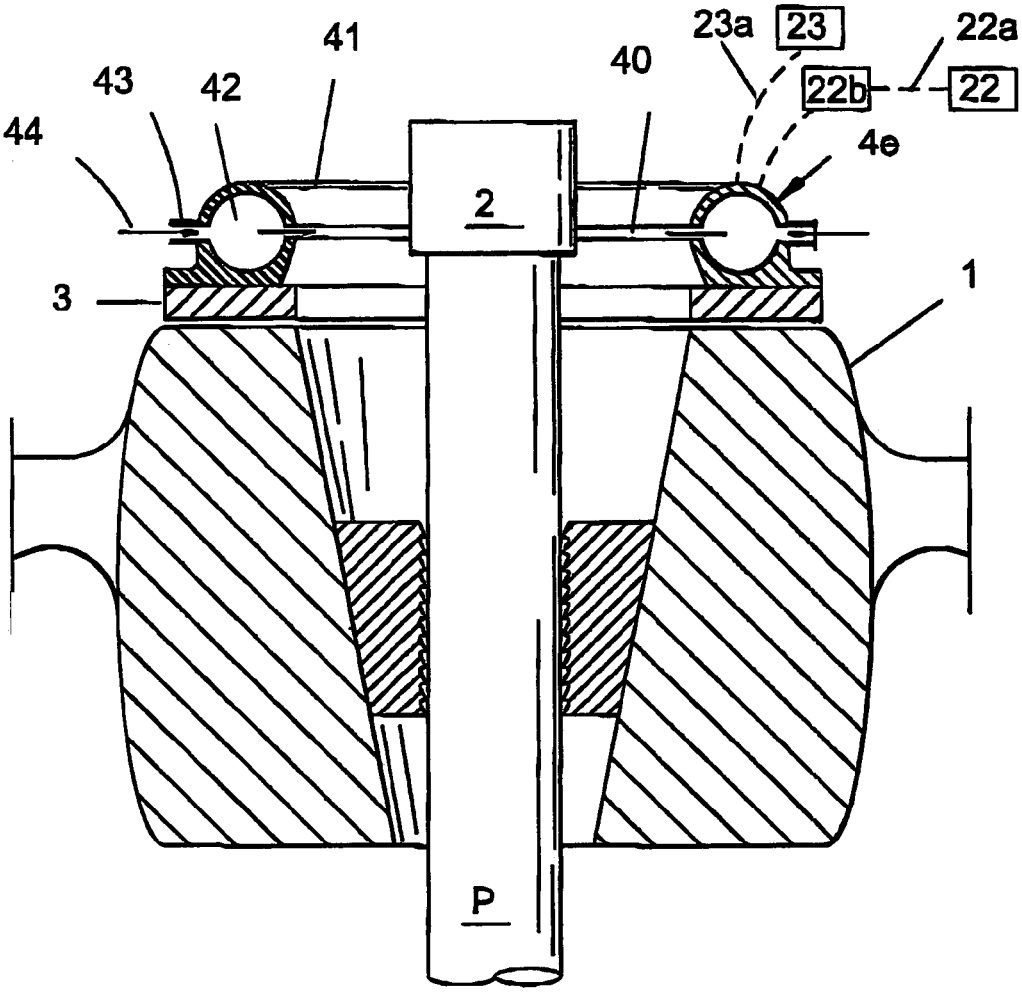
FIG. 11 illustrates a side view, mostly in cut-away, of an air curtain detector system.

FIG. 11 illustrates a thin profile air curtain sensor 4*e*. As with the other sensor described herein, sensor 4*e* is attachably mounted either directly onto the elevator 1 or on a transition plate 3 or even a spring biased transition plate 3*a* (FIG. 8). The method of mounting the sensor 4*e* will preferably be similar to other sensors with the ultimate goal of a secure positioning of the sensor 4*e*. It should be appreciated that the thin profile air curtain sensor is a commercially available apparatus and as such would have a manufacturers preferred or suggested mounting instruction. In the illustrated embodiment, the annular chamber 42 is preferably contained in a housing 41 and may be supplied an air stream 44 through supply tube 43. Slit nozzle 40 is preferably peripherally distributed around the central through bore opening in the elevator 1. Preferably, the air being projected substantially radially inward from the slit nozzle 40 causes a back pressure in chamber 42 that is influenced by any object encountered by the moving air stream. With a given air flow 44 the pressure in chamber 42 will preferably be a pre-determined or pre calculated amount when no object is in the elevator central opening to obstruct the air flow. Preferably, when an object protrudes into the central opening, the chamber 42 pressure rises. Preferably, the rise in the chamber 42 pressure is proportional to the effective diameter of the object which protrudes into the central opening. Therefore, as the collar 2 protrudes into the central opening and into the air stream, the pressure would rise to the pre-determined or pre-calculated pressure which corresponds to the diameter of the collar. As the tubular P continues to move through the opening (i.e. as the elevator 1 is being lowered around the tubular P), the collar will eventually move through the air stream. As the collar 2 clears the air stream, the pressure will drop some calculated or pre-determined amount indicating a smaller diameter. At this point, it should be evident from the measured pressure (at the gauge or other measuring indicator) that the collar 2 has moved above the air stream and therefore the slips can be activated. The chamber 42 pressure may be read by a driller watching a gauge 22. The gauge 22 can be placed where desired or convenient for the driller. Preferably, if the pressure gauge 22 is not directly attached to the chamber 42, the pressure may be transmitted through the communication link 22A to the location of the gauge 22. It should be appreciated that in order to transmit the pressure to a remote gauge 22, some type of conventional pressure transducer 22B will be required. Further, the pressure can be transmitted along the communication link 23A and converted to other signal forms by a computer cell or processor 23 for use by the operators, drillers, other personnel. It should be appreciated that conventional processors 23 are commercially available that can translate the pressure signal to an electrical signal, a pneumatic signal, a combination electro-pneumatic signal, or other required signal. It should be further appreciated that either the direct air pressure measurement or any processed signal can be sent to a rig interlock system or other conventional automatic controller to set or open the slips 9 as desired. The signal can be sent to other computers which monitor the rig operation. It should be noted that persons skilled in the art do not need to be computer experts or programmers in order to utilize the sensors. The programming of the signal processors, computers, automatic controllers, and the like is typically provided by the sensor manufacturers or rig operating programmers.

Figure 12:
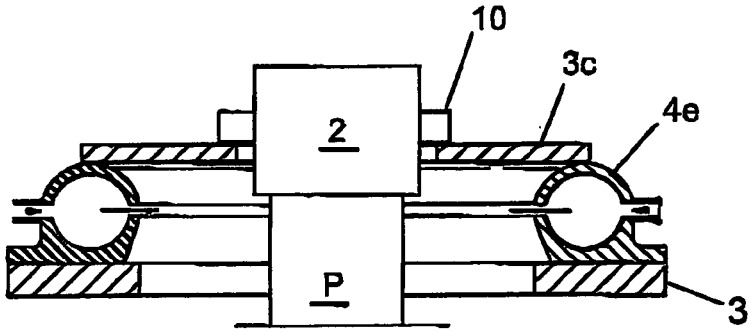
FIG. 12 illustrates a side view, simplified, of a stacked sensor arrangement.

FIG. 12 illustrates an embodiment with a stacked sensor arrangement. In this embodiment, sensor 10, which may be the type illustrated in FIG. 3, is situated above sensor 4*e*. As illustrated here, the sensor 4*e* is mounted to the transition plate 3. This mounting can be the same as described herein above. A secondary transition plate 3*c* is mounted above sensor 4*e*. The secondary transition plate 3*c* is preferably attached by brackets (not shown) to the sensor 4*e* or directly to the transition plate 3. It should be appreciated that the two sensors 10, 4*e* should be vertically spaced some pre-determined distance so that the vertically higher sensor 10 can sense the diameter of the collar 2 at the same time that the vertically lower sensor 4*e* can sense the smaller diameter of the tubular P. Preferably, when sensor 10 senses the larger diameter of the collar 2 and sensor 4*e* senses the smaller diameter of the tubular P, the signals from both the sensors 10, 4*e* will thus indicate that the collar-to-tubular transition is between the two sensors. As illustrated in FIGS. 3, 4, and 11 and described herein above, the sensors 10, 4*e*, may transmit signals to processors, gauges, computers and the like so that the operating personnel can interpret the data for accurate positioning information. It should be understood that the illustrated arrangement may utilize single point sensors even if the tubular moves laterally some limited amount. It should be appreciated that the stacked sensor arrangement can utilize combinations of the sensors described and illustrated herein above. Those skilled in the art will appreciate that the selection of sensors and the use of combined or stacked sensors will depend on the rig environment as to which type of sensors will provide the best operational functionality and the rig requirements for safety and redundant systems.

Figure 13D:
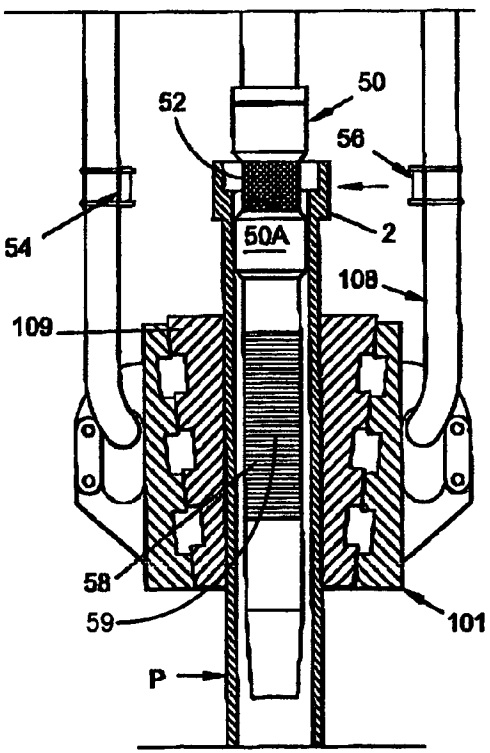
FIG. 13D is similar to FIG. 13A but illustrates the slips in the set position.
Figure 13A:
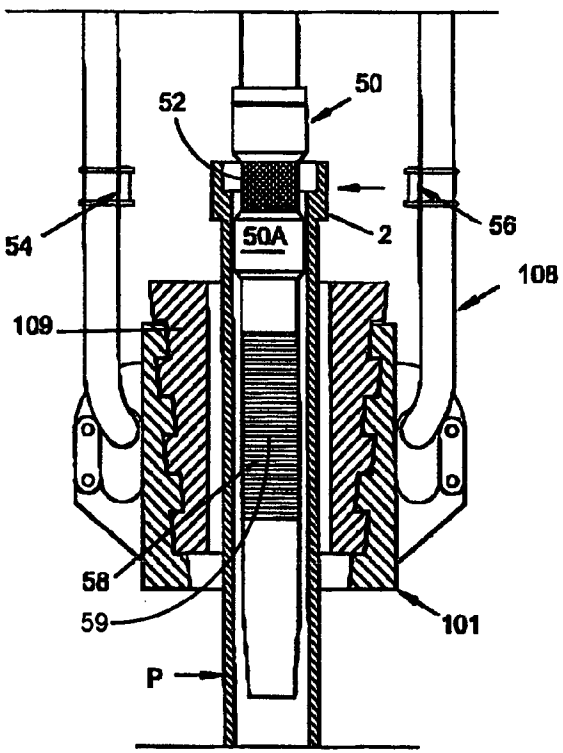
FIG. 13A is similar to FIG. 13 but illustrates the reflective area lowered out of contact with the sensor.
Figure 13:
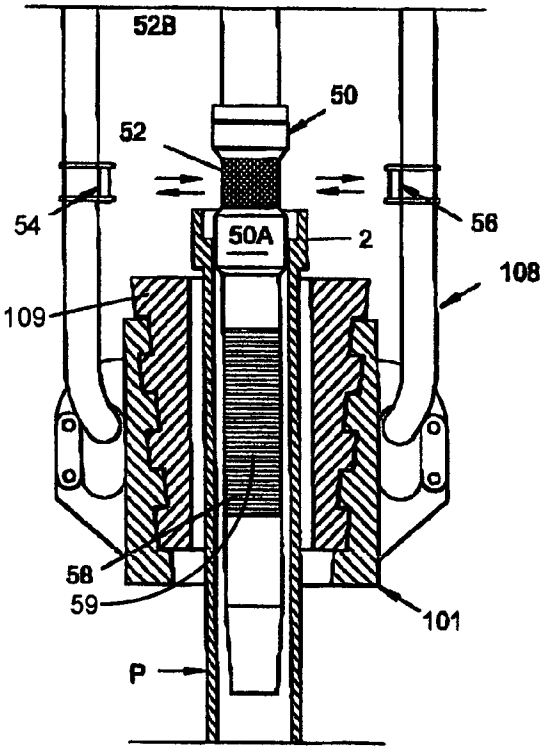
FIG. 13 illustrates a side elevation of a typical elevator suspended by bails and further illustrating another embodiment of the present invention.

FIG. 13 illustrates another embodiment of the present invention. In this embodiment, the sensor 56 and the reflector 54 may be mounted on the elevator bails, as illustrated here, or they can be mounted on the elevator top guard, on the transition plate 3 (see FIG. 1) or other convenient or desired position so as to detect the position of a tubular or tool. The embodiment illustrated in FIG. 13 preferably utilizes the sensor system to monitor the position of a tool or other equipment or object being lowered into a tubular P. It should be noted that although the present invention will be described in conjunction with the lowering of an oil field tool into a wellbore, this is only for illustration and the utility of the present device can be applied to both the oil and gas exploration and drilling as well as non-oil field related applications.

FIG. 13 illustrates an oil field tool, generally designated with the numeral 50, being mounted to a rig top drive or other suitable equipment. The elevator 101 is suspended, by bails 108, from the same equipment as the tool 50. Thus, preferably, the elevator 101 and the tool 50 descend and ascend as a substantially tandem unit. Preferably, in this embodiment, the sensor 56 is mounted to the bails, but can also be mounted as described herein above. A reflector 54 is preferably mounted at a position substantially 180 degrees from the sensor 56 such that anything projected or emanating from sensor 56, for the purpose of determining some characteristic such as position, will be reflected by the reflector 54 as long as no object penetrates the substantially horizontal plane between the sensor 56 and the reflector 54. It should be noted that sensor 56 can send out or emit signals which include, but are not limited to, light, air, sound, or fluid. The exact position of the sensor 56 and the reflector 54, relative to the elevator is pre-determined depending the type of equipment being lowered in conjunction with the elevator.

Figure 14:
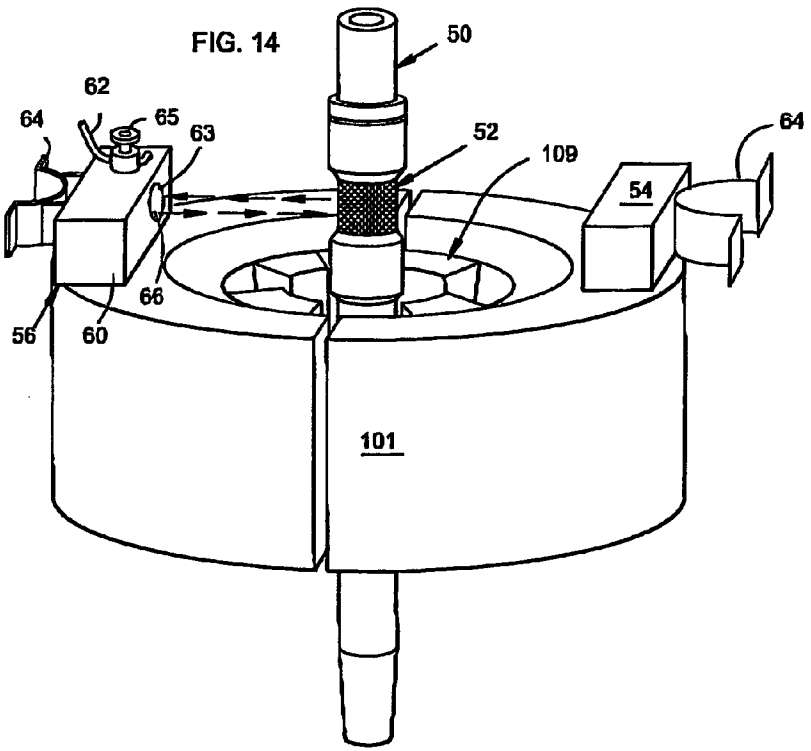
FIG. 14 is similar to FIG. 13 but illustrates a more detailed view of the sensor and reflective areas.

FIG. 14 more fully illustrates the sensor 56 and reflector 54. Preferably, the sensor 56 and the reflector 54 are mounted to the bails 108 with brackets 64. It should be appreciated that the brackets 64 are preferably releasably attached to the bails 108 using u-bolts or other suitable fasteners. It may also be desirable that the brackets 64 are more permanently attached if the sensor system will be used for an extended period of time or if a more secure mounting attachment is desired. It should further be understood that the brackets 64 can be fixedly attached to the sensor 56 and the reflector 54 or can be integral to the sensor and reflector housings. The method of attachment of the brackets 64 to the sensor 56 and reflector 54 and the brackets 64 to the bails 108 or elsewhere near the elevator 101 is usually a matter of preference for the operators or the service providers and thus should not be viewed as a limitation of the present invention. This preference will also dictate other methods of attachment including the use of other types of brackets or even no brackets.

Preferably, sensor 56 will have the capacity to both emit and receive a particular signal. As illustrated, in FIG. 14, the sensor housing 60 will preferably have an opening 63 which will both send and receive a signal. The opening 63 can be a single opening or can be a plurality of openings. The opening 63 or plurality of openings will preferably be covered by a suitable lens 66 which will not interfere with any signal emitted or received by the sensor 56. The sensor 56 can be operated remotely and can also have energizing and de-energizing switches locally within or attached to the housing 60. Preferably, the housing 60 will also have attached to it an air line 62. The air flowing through the air line 62 will preferably keep the lens 66 clean to avoid unintended interference with the signal being emitted or received. Preferably, at least one valve 65 will control the air flow. It should be noted that the air control system can be manually controlled through any conventional valve or can be remotely controlled through suitable electro pneumatic or pneumatic control systems.

Referring again to FIG. 13, the tool 50 which is suspended and travels substantially simultaneously with the elevator 101 is preferably provided with a reflecting surface 52. This reflecting surface 52 is applied at substantially the same distance from the elevator 101 as are the sensor 56 and reflector 54. Therefore, the sensor emits a signal which travels through substantially the same plane as the reflector 54 and the reflecting surface 52 of the tool 50. Thus, in operation, the sensor 56 would preferably emit a signal which will either be reflected by the reflector 54 or the reflecting surface 52 of the tool 50. It should be appreciated that the reflecting surface 52, applied to the tool 50, is preferably a renewable type of reflective tape. However, reflecting surface 52 as well as reflector 54 can be comprised of any variety of reflecting surfaces which are suitable to reflect the type of signal being emitted from the sensor 56. It should further be noted that the selection of the reflecting material considers the environmental factors so as to avoid contamination and thus decrease the reflective capacity of the surface.

As described herein above, the elevator is preferably lowered until it surrounds the pipe or tubular P which requires manipulation by the elevator. When signaled, the elevator slips, designated herein as 9 or 109, will close around tubular P. FIG. 13A illustrates the tool 50 inside the tubular P. When this occurs, the signal emitted by the sensor 56 is no longer reflected and a signal can be sent by the sensor 56 indicating that the tubular P has sufficiently passed through the elevator 101 and that the slips can be set. FIGS. 13–13D also illustrate a flexible hose 58 which preferably aids in the alignment of the tool as it is inserted into the tubular P. It should be understood that while these Figures refer only to a tubular P, it is clear from the illustrations that the upper end of the tubular P has an upset end or a collar which has been designated herein above with the numeral 2.

In operation, as the tool 50 and thus the elevator 101 and the sensor 56 are lowered toward tubular P, or raised away from tubular P, the sensor 56 emits a signal which is then preferably reflected back to the sensor's 56 receiving apparatus. Thus, the sensor 56 will provide an indication that the tool 50 is not sufficiently engaged the tubular P to actuate the internal slips 59. It should be noted that as illustrated in FIGS. 13–13D. a device may have one or both of a flexible guide hose 58 or an internal gripping tool 59. Further, if both are present, preferably the guide hose 58 would be below the slips 59.

As illustrated in FIG. 13A, when the tool 50 has ,been lowered into the tubular P some pre-determined distance, the reflecting surface 52 as well as the reflector 54 are obscured from the sensor's 56 emitted signal. In operation, the sensor will indicate to the drilling personnel or to some automated control system that the tool 50 is sufficiently within the tubular P and that the internal slips 59 can be actuated. It should be appreciated that the signal from the sensor 56 can be sent to a variety of processors, computer cells, or controllers as described herein above for other sensors. It should further be appreciated that such signals can provide rig personnel with audible and visual indicators as well as automatically set the slips. However, due to many of the current safety systems the automatic setting of the slips may be prohibited as some manual operations are reserved for the rig operators to prevent some critical equipment from malfunctioning when operated under complete automatic control.

Figure 15:
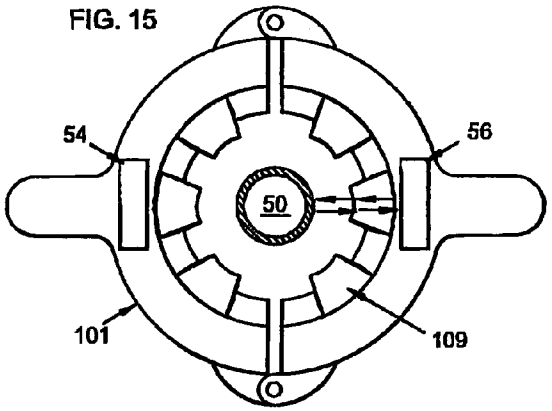
FIG. 15 illustrates a top view of the elevator with the sensor detecting the reflective area.
Figure 16:
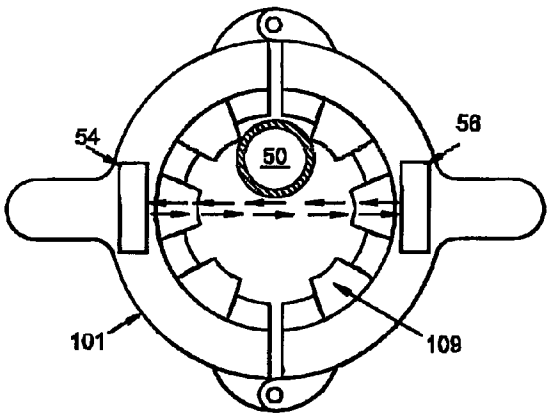
FIG. 16 is similar to FIG. 5 but shows the sensor reflective capability when the target reflective area has shifted.

As illustrated in FIGS. 13–13D, the tool 50 is lowered substantially in tandem with the elevator 101 and the bales 108. The elevator 101 and the slips 109 are preferably sized so as to fit over the tubular P. Because the tool 50 is intended to fit into the interior diameter of the tubular P. tool 50 preferably has a smaller outer diameter than tubular P, the slips 109, and the elevator 101. Therefore, in operation, it may be possible for the tool 50 to become positioned in an offset angle which could cause the reflecting surface 52 to move out of alignment with the signal being emitted from the sensor 56. In such a case, the reflector 54 would reflect such signal from the sensor 56 and preferably prevent a false indication causing the drilling personnel or any automatic control system to prematurely set the internal slips 58 or elevator slips 109. FIGS. 15 and 16 illustrate this above described alignment situation as well as the redundant reflective system for preventing false indications of the tool 50 position relative to the tubular P.

Figure 13C:
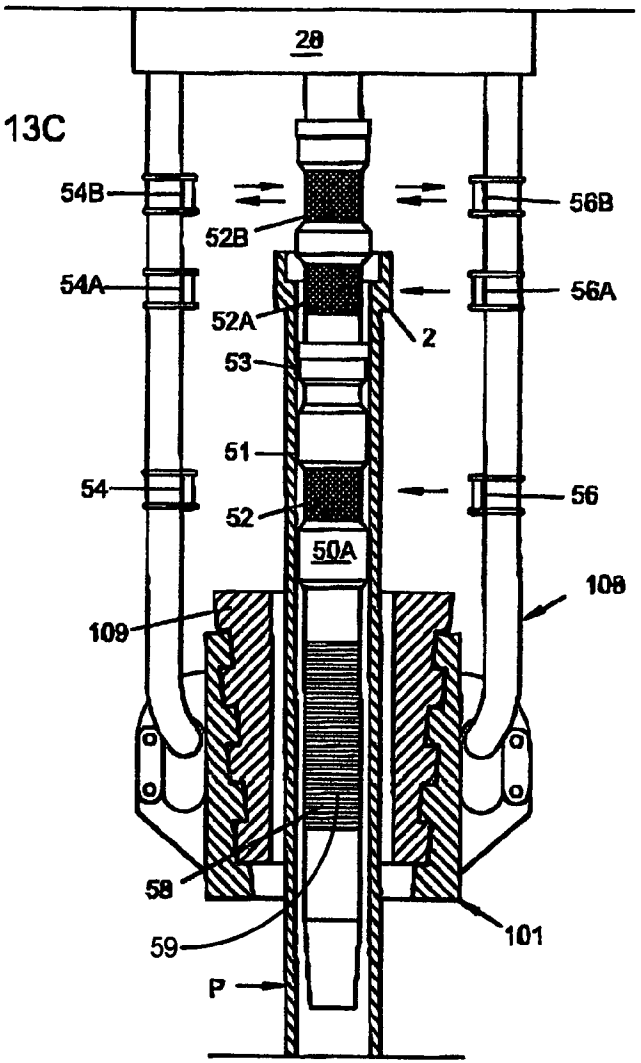
FIG. 13C is similar to FIG. 13B but illustrates the reflective areas lowered out of contact with the sensor.
Figure 13B:
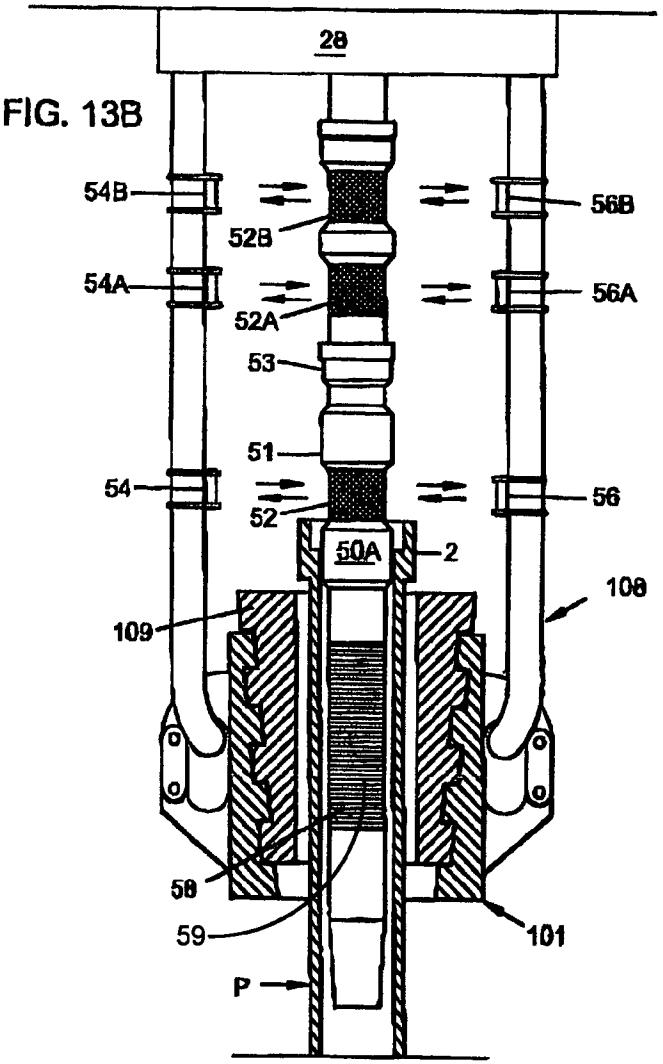
FIG. 13B is similar to FIG. 13 but illustrates three sensor/reflector systems.

FIGS. 13B and 13C illustrate a multiple sensor/reflector system. In this alternate embodiment and additional sensors 56A and 56B are mounted substantially in the same horizontal plane and substantially 180 degrees from corresponding reflector 54A and 54B. This embodiment may be used to provide a safety redundancy feature or to locate more than one tool or feature of a tool. In the case of this embodiment, the three sensors 56, 56A, 56B may provide indication such as when the tool enters the tubular P, another signal of when the tool has been inserted a certain pre-determined distance, and an anti-collision alarm when the traveling block 28 has reached a certain pre-determined level where contact may be imminent between the traveling block 28 and some other equipment such as, but not limited to, the tubular P. This technology can be used when the same tool or same tools on the string need to be inserted a certain pre-determined distance before either or both are activated or energized.

In further detail, FIGS. 13B and 13C illustrate tool 50 which may comprise a conventional tool coupler 50A. Directly above the coupler 50A is the first reflective surface 52. Above the reflective surface 52 is a conventional gauge ring 51. The gauge ring 51 is preferably used to center the tool assembly in tubular P. Above the gauge ring 51 may be a packer 53 or other type of seal which may be utilized to seal the top of tubular P in order to pressure up the tubular string. Above the packer 53 or seal is preferably the second reflective surface 52A. Some pre-determined distance above the second reflective surface 52A may be a third reflective surface 52B. It should be appreciated that each reflective surface has a corresponding sensor 56, 56A, 56B and a corresponding reflector 54, 54A, 54B preferably attached to the bails 108. It should be understood that each set of sensor, reflector, and reflective surface should be aligned in substantially the same horizontal plane. It should further be understood that the selection of one or multiple sets of sensors/reflectors is a factor of the rig environment, the required degree of safety, the number or types of tools being lowered into the tubular P, or any other rig operation requirements.

FIG. 13B illustrates the tool assembly above the tubular P while FIG. 13C illustrates the tool assembly inserted into the tubular P. In operating an embodiment, such as illustrated in FIGS. 13B and 13C, the first set of sensors/ reflectors (56, 54, 52) will preferably indicate when the pipe has passed some predetermined distance through the through bore of the elevator 101. The second set of sensors/reflectors (56A, 54A, 52A) will preferably provide indication of when the packer 53 has been inserted some pre-determined distance inside the tubular P. And as described herein above, the third set of sensors/reflectors (56B, 54B, 52B) will preferably provide a signal or warning alarm when the traveling block 28 is approaching close to some pre-determined elevation such as near the tubular P. It should be appreciated that the anti-collision warning, as provided by the third set of sensors/reflectors (56B, 54B, 52B), is important to prevent damage to the operating rig or even injury to the rig personnel.

FIG. 13D illustrates the slips 109 being set when the reflective area 52 has substantially completely entered into the tubular P.

It should be appreciated, by those in the art, that the multiple sensors 56, 56A, can also be utilized to indicate when it is safe to energize a seal or packer. In some applications, when using a mud filling tool 50, it is desirable to seal the tubular opening to provide additional fluid pressure to circulate the mud through the tubulars P and into the wellbore. The seal or packer must be inserted some pre-determined distance into the tubular P in order to ensure that the seal will not blow out. Thus, sensor 56, will indicate that the tool has been inserted into the tubular and sensor 56A will indicate when the seal or packer has been fully inserted and can be energized.

In another embodiment, the sensors, described herein above, may be utilized when operating an internal elevator tool such as described in U.S. Pat. No. 6,309,022 (issued to Bouligny; Oct. 30, 2001). The internal elevator tool is a multi-purpose tool which may be used, but is not necessarily limited to, to lower a tubular section P into a wellbore, can facilitate the flow of mud or drilling fluids into the tubular string, and rotate the tubular string should there be some obstruction during lowering. The sensors, described herein above, may preferably indicate when the internal elevator tool has been inserted into the tubular P some pre-determined amount. When the tool has been inserted the desired dimension, the internal gripping apparatus can be set and thus support the tubular P. As described, herein above, regarding the packer 53 (FIGS. 13B and 13C), it is preferred that the internal elevator tool be inserted sufficiently into the tubular P to prevent premature release or slippage of the internal gripping apparatus. In this embodiment, the selected sensors would preferably be mounted on the guide rails of the traveling block. The mounting position would be some pre-determined distance from the tubular P. The manner of attachment and mounting would preferably be similar to the attachments of sensors to the elevator bales. The preferred sensor system would be the above described sensor/reflector system. The sensors would preferably indicate when the traveling block has reached a pre-determined elevation which would mean that the internal elevator tool has been inserted to a desired depth inside the tubular P and that the internal gripping device could be set. It should be appreciated that the specific selection of sensors, the mounting of the sensors, and the desired form of position indication is a function of the rig environment, rig safety procedures, and the like.

The present invention envisions that the embodiments described herein above can be combined to provide efficient operation of the drilling, casing, and completion process for oil well drilling or servicing. When tubulars are lowered into the wellbore, whether for drilling, completion, or servicing, the tubular sensing system will preferably allow positive location of the tubular P so as to enable proper engagement of the elevator slips with the tubular. Further, when some tool or other equipment is needed to be lowered into the wellbore or to assist the lowering of tubulars into the wellbore, the sensing system can also preferably provide sensors for providing positive indication of the tool or other equipment being inserted in the tubular some pre-determined or critical distance. When this indication is provided, the tool or other equipment being inserted can be actuated to preferably engage the interior of the tubular P. Therefore, it may be desirable to combine sensors, such as illustrated in FIGS. 1–12 with the sensors illustrated in FIGS. 13–16. In such case, the various sensors can be mounted or positioned as described herein above to provide multiple indications of positions with respect to any tools, tubulars, traveling block, or any other rig or derrick equipment. It should be appreciated that when such described combinations of tools are utilized, the specific placement and attachment would be at certain pre-determined or pre-calculated distances. It should further be appreciated that the signals generated from the multiple sensors would be processed by conventional and commercially available processors or computers to provide the rig personnel with output data such that all the inter-related positioning could be understood and utilized.

Further, it should be understood that although the descriptions herein above have focused on the insertion of tools into the tubular P or the lowering of the elevator 1, 101 over the tubular P, the same sensors, as described herein above, can be utilized when tools are retracted from the wellbore or from tubulars or as tubulars are removed from the wellbore. Thus the sensors, can aid in providing rig personnel with positioning data as tools, tubulars, or other equipment is being removed.

It should be appreciated that although the present apparatus has been described as functioning separately when determining the tubular P diametrical characteristics and when providing indication of insertion depth, it is envisioned that a sensing system can be combined to provide both desired functions through the availability of advanced processing systems currently available, being developed, or awaiting more technological advances.

From the foregoing, it will be seen that the present invention is one well adapted to ascertain positions of tubulars, pipes, collars, tools, and a variety of tubular type goods. It should be appreciated that certain embodiments of the present invention are not limited to specifically interact with oilfield tubulars or even tubulars of any kind, they can likewise be adapted to other uses where sensing of size variations or positions is required or desired. It should be further appreciated that other advantages which are obvious and which are inherent to the present invention should not be limited by the examples presented in the foregoing descriptions. It will be understood that certain features and sub-combinations are of utility and may be employed without reference to other features and sub-combinations. This is contemplated by and is within the scope of the claims.

As many possible embodiments may be made of the locator of this invention without departing from the scope thereof, it is to be understood that all matter herein set forth or shown in the accompanying drawings is to be interpreted as illustrative and not in a limiting sense.

What is claimed is:

1. A tubular string feature locator for detecting when a selected characteristic on a tubular string suspended in a well has a preselected vertical relationship to a rig elevator, the locator comprising:

sensor means to detect at least one characteristic of the tubular that has a known vertical relationship to a location on the tubular selected for gripping with elevator mounted tubular gripping means and to produce an output signal when the characteristic is sensed; and a sensor mounting arrangement that places the sensor means the same distance and direction from the elevator tubular gripping means as the known distance and direction between the characteristic to be sensed and the location on the tubular selected for gripping, wherein the sensors are arranged with at least two vertically adjacent sensors on different vertical locations, and wherein the sensors collectively accommodate lateral movement of said tubular, both sensing the movement, and the feature change being sensed when one sensor detects tubular string features the other sensor does not detect.

2. A tubular string feature locator for detecting the vertical position of a tubular string suspended in a well relative to a drilling rig elevator, the locator comprising:

said drilling rig elevator to function as a carrier for tubular feature sensors and related mounting means;

a plurality of said tubular feature sensors mounted on said elevator and arranged to sense selected characteristics of the tubular extending through the elevator and to produce an output signal component indicative of the presence of the selected tubular characteristics, wherein the sensors are arranged with at least two vertically adjacent sensors on different vertical locations, and wherein the sensors collectively accommodate lateral movement of said tubular, both sensing the movement, and the feature change being sensed when one sensor detects tubular string features the other sensor does not detect; and the total of said signal components to comprise a signal to indicate the presence of said feature.

3. The tubular string feature locator according to claim 2 wherein said sensor comprises a plurality of sensors, each of which has a mechanical element extending from the sensor to the surface of the tubular extending through the elevator.

4. An oilfield tubular string feature locator for detecting the vertical position of an oilfield tubular string suspended in a well relative to a drilling rig elevator, the locator comprising:

said drilling rig elevator to function as a carrier for tubular feature sensors and related mounting means; and at least one of said tubular feature sensors mounted on said elevator and arranged to sense selected characteristics of the tubular extending through the elevator and to produce an output signal indicative of the presence of selected tubular characteristics, wherein said sensor emits sound to travel through the airspace surrounding the tubular to impinge upon the surface of the tubular, and respond to airborne echo characteristic to determine the distance between reference features on the tubular, and the sensor, said output signals from said sensor being processed to produce sensed tubular feature related information and wherein the sensors are arranged with at least two vertically adjacent sensors on different vertical locations, and wherein the sensors collectively accommodate lateral movement of said tubular, both sensing the movement, and the feature change being sensed when one sensor detects tubular string features the other sensor does not detect.

5. An apparatus for indicating a desired position of a suspended insertable oil field assembly capable of being lowered into a tubular comprising:

a traveling block from which are suspended at least two bails having first and second lower ends respectively;

an elevator fixedly attached to said bails;

an insertable oil field assembly, having a lower end, suspended from said traveling block, whereby said traveling block insertably lowers said insertable oil field assembly into a tubular positioned below said traveling block, wherein said insertable oil field assembly has a first reflecting surface disposed about said insertable oil field assembly at a pre-determined distance from the lower end of said insertable oil field assembly; and a sensor, being lowered substantially in tandem with said insertable oil field assembly and capable of emitting a signal to be reflected by said first reflecting surface disposed about said insertable oil field assembly, wherein the reflected signal indicates the position of said insertable oil field assembly relative to said tubular, and wherein said elevator grips said tubular when the reflected signal indicates a desired position of said insertable oil field assembly.

6. An apparatus for indicating a desired position of a suspended insertable oil field assembly capable of being lowered into a tubular comprising:

a traveling block from which are suspended at least two bails having first and second lower ends respectively;

an elevator fixedly attached to said bails;

an insertable oil field assembly, having a lower end, suspended from said traveling block, whereby said traveling block insertably lowers said insertable oil field assembly into a tubular positioned below said traveling block, wherein said insertable oil field assembly has a first reflecting surface disposed about said insertable oil field assembly at a pre-determined distance from the lower end of said insertable oil field assembly;

a second reflecting surface wherein said second reflecting surface is positioned substantially 180 degrees from said sensor, and wherein said second reflecting surface being capable of reflecting said sensor signal when said first reflecting surface is mis-aligned; and a sensor, capable of emitting a signal to be reflected by said first reflecting surface disposed about said insertable oil field assembly, wherein the reflected signal indicates the position of said insertable oil field assembly relative to said tubular.

7. The position indicating apparatus of claim 6 wherein said sensor, said first reflecting surface, and said second reflecting surface are substantially aligned in the same horizontal plane.

8. The position indicating apparatus of claim 5 wherein said sensor is mounted on said bails.

9. The position indicating apparatus of claim 5 wherein said sensor is mounted on said elevator.

10. An apparatus for indicating the position of an oil field assembly suspended for insertion into a tubular comprising:

a rig suspension system for lowering tubulars and oil field assemblies, each having an outside surface, into a wellbore;

a first reflective surface disposed about the outside surface of said oil field assembly;

a second reflecting surface for reflecting said sensor emitted signal when the first reflecting surface is mis-aligned;

an elevator fixedly attached to said rig suspension system; and a sensor mounted to said elevator, said sensor being capable of emitting a signal capable of being reflected by said first or second reflective surface, wherein said reflected signal indicates the position of said oil field assembly with respect to said tubular.

11. The apparatus of claim 10 wherein said sensor and said first or second reflecting surfaces are substantially aligned in the same horizontal plane.

12. An apparatus of claim 10 wherein said sensor further comprises:

a housing for fixedly mounting said sensor to said rig suspension system;

a signal emitter for emitting a signal capable of being reflected by said reflecting surface;

a signal receiver for receiving the signal reflected by said reflecting surface;

a cover for the signal emitter and the signal receiver; and an air supply, wherein said air supply provides air flow across said cover to prevent substance accumulation which will interfere with said signal emitter and signal receiver device.

13. A sensor indicating the position of an oil field assembly suspended for insertion into a tubular comprising:

a housing for fixedly mounting said sensor to a rig suspension system;

a signal emitter for emitting a signal capable of being reflected by a reflecting surface, said reflecting surface being disposed about said oil field assembly;

a signal receiver for receiving the signal reflected by said reflecting surface;

a cover for the signal emitter and the signal receiver; and an air supply, wherein said air supply provides air flow across said cover to prevent substance accumulation which will interfere with said signal emitter and signal receiver, wherein the reflected signal indicates the position of said oil field assembly with respect to said tubular.

14. The sensor of claim 13 wherein said sensor is mounted to elevator bails depending from said rig suspension system.

15. The sensor of claim 13 wherein said sensor is mounted on an elevator depending from said rig suspension system.

16. A tubular string feature and position locator for detecting the vertical position of a tubular suspended in a well bore comprising:

a drilling elevator to function as a carrier for sensors and related mounting apparatus;

at least one sensor mounted on said elevator arranged to sense selected characteristics of the tubular extending through the elevator and to produce an output signal indicative of the presence of selected tubular characteristics;

at least one sensor mounted on said elevator arranged to sense the position of an insertable oil field assembly suspended, for insertion into said tubular, from a drilling rig and being lowered substantially in tandem with said elevator, said sensor being capable of producing an output signal indicative of the position of the suspended insertable oil field assembly relative to said tubular.

17. A tubular string feature and position locator of claim 16 wherein the sensors for detecting the tubular characteristics and the insertable oil field assembly position are mounted in a single housing and wherein the output signal is processed to indicate said tubular characteristics and said position indication.

18. A method for indicating a desired position of a rig suspended insertable oil field assembly capable of being lowered into a tubular comprising:

providing a rig suspension and lowering system;

lowering an elevator which is lowered substantially in tandem with said rig suspended insertable oil field assembly;

suspending said insertable oil field assembly, having a lower end, from said rig suspension and lowering system, whereby said rig suspension and lowering system insertably lowers said insertable oil field assembly into a tubular positioned below said rig suspension and lowering system, wherein said insertable oil field assembly has a first reflecting surface disposed about said insertable oil field assembly at a pre-determined distance from the lower end of said insertable oil field assembly;

emitting a signal to be reflected by said first reflecting surface disposed about said insertable oil field assembly, wherein a source of the signal, being emitted and reflected by the first reflecting surface, is substantially aligned in the same horizontal plane as the first reflective surface while the insertable oil field assembly is being raised or lowered by the rig suspension system, and wherein the reflected signal indicates the position of said insertable oil field assembly relative to said tubular; and indicating, by a signal, that said insertable oil field assembly has been insertably positioned within said tubular at a pre-determined distance.

19. A tubular string feature and position locator for detecting the vertical position of a tubular suspended in a well bore comprising:

a traveling block from which are suspended at least two bails having a first and second lower ends respectively;

a drilling elevator to function as a carrier for sensors and related mounting apparatus, wherein said elevator is suspended from said at least two bails;

at least one sensor mounted on said elevator arranged to sense selected characteristics of the tubular extending through the elevator and to produce an output signal indicative of the presence of selected tubular characteristics; and at least one sensor mounted on said bails arranged to sense the position of an insertable oil field assembly suspended, for insertion into said tubular, from a drilling rig and being lowered substantially in tandem with said elevator, said sensor being capable of producing an output signal indicative of the position of the suspended insertable oil field assembly relative to said tubular.

* * * * *